US008547280B2

(12) United States Patent
Yang et al.

(10) Patent No.: US 8,547,280 B2
(45) Date of Patent: Oct. 1, 2013

(54) SYSTEMS AND METHODS FOR EXCITING LONG SLOT RADIATORS OF AN RF ANTENNA

(75) Inventors: Fangchou Yang, Los Angeles, CA (US); Hee Kyung Kim, El Segundo, CA (US); Shahrokh Hashemi-Yeganeh, Rancho Palos Verdes, CA (US); Clifton Quan, Arcadia, CA (US); Alberto F. Viscarra, Torrance, CA (US); Robert W. Ladera, Fullerton, CA (US)

(73) Assignee: Raytheon Company, Waltham, MA (US)

( * ) Notice: Subject to any disclaimer, the term of this patent is extended or adjusted under 35 U.S.C. 154(b) by 445 days.

(21) Appl. No.: 12/836,442

(22) Filed: Jul. 14, 2010

(65) Prior Publication Data

US 2012/0013514 A1 Jan. 19, 2012

(51) Int. Cl.
*H01Q 1/38* (2006.01)

(52) U.S. Cl.
USPC ..... 343/700 MS; 343/789; 343/898

(58) Field of Classification Search
USPC ..... 343/700 MS, 789, 898
See application file for complete search history.

(56) References Cited

U.S. PATENT DOCUMENTS

| | | | | |
|---|---|---|---|---|
| 5,337,065 | A | 8/1994 | Bonnet et al. | |
| 6,624,787 | B2 * | 9/2003 | Puzella et al. | 343/700 MS |
| 6,674,340 | B2 | 1/2004 | Quan et al. | |
| 6,747,606 | B2 | 6/2004 | Harel et al. | |
| 7,057,563 | B2 | 6/2006 | Cox et al. | |
| 7,336,232 | B1 | 2/2008 | Lee et al. | |
| 7,525,498 | B2 | 4/2009 | Quan et al. | |
| 7,903,035 | B2 * | 3/2011 | Mikkola et al. | 343/702 |
| 2008/0088519 | A1 * | 4/2008 | Quan et al. | 343/770 |
| 2008/0191953 | A1 * | 8/2008 | Bruno et al. | 343/769 |
| 2009/0231226 | A1 | 9/2009 | Quan et al. | |
| 2011/0114242 | A1 * | 5/2011 | Kim et al. | 156/49 |

OTHER PUBLICATIONS

Extended European Search Report for European Application No. 11170908.5, Extended European Search Report dated Oct. 18, 2011 and mailed Oct. 28, 2011 (5 pgs).

* cited by examiner

*Primary Examiner* — Douglas W Owens
*Assistant Examiner* — Jae Kim
(74) *Attorney, Agent, or Firm* — Christie, Parker & Hale, LLP

(57) ABSTRACT

Provided is a radiator transition assembly for exciting a long slot radiator of an antenna, the transition assembly including a folded flexible circuit substrate including at least two folds forming a long slot radiator, an excitation circuitry configured to generate signals for exciting the long slot radiator, and a microstrip transmission line coupled to the excitation circuitry and positioned along the folded flexible circuit substrate, where the microstrip transmission line extends across an opening of the long slot radiator.

17 Claims, 12 Drawing Sheets

SYSTEMS AND METHODS FOR EXCITING LONG SLOT RADIATORS OF AN RF ANTENNA

STATEMENT REGARDING FEDERALLY SPONSORED RESEARCH OR DEVELOPMENT

This invention disclosure is related to Government contract number FA8750-06-C-0048 awarded by the U.S. Air Force. The U.S. Government has certain rights in this invention.

BACKGROUND

The present invention relates generally to systems and methods for constructing and operating lightweight radio frequency (RF) antennas. More specifically, the invention relates to systems and methods for exciting long slot radiators of an RF antenna.

Next generation large area multifunction active arrays for applications such as space and airborne based antennas need to be lighter weight, lower cost and more conformal than what can be achieved with current active array architecture and multilayer active panel array development. These space and airborne antennas can be used for radar and communication systems, including platforms such as micro-satellites and stratospheric airships.

To address the need for lower cost and lightweight antennas, lightweight materials can be used to form antenna component structures. However, such lightweight materials can present new challenges for assembling antenna structures capable of providing sufficient performance in radar and communication systems.

SUMMARY

Aspects of the invention relate to systems and methods for exciting long slot radiators of an RF antenna. In some embodiments, the invention relates to a radiator transition assembly for exciting a long slot radiator of an antenna, the transition assembly including a folded flexible circuit substrate including at least two folds forming a long slot radiator, an excitation circuitry configured to generate signals for exciting the long slot radiator, and a microstrip transmission line coupled to the excitation circuitry and positioned along the folded flexible circuit substrate, where the microstrip transmission line extends across an opening of the long slot radiator. In one such embodiment, the opening forms a slot aperture in the folded flexible circuit substrate. The opening can have an elongated rectangular shape. In some cases, the opening can have an elongated rectangular shape with transverse stubs at the ends of the shape.

In another embodiment, the opening is defined by a space between adjacent folds of the folded flexible circuit substrate. In such case, the assembly can include a flat flexible circuit substrate attached to the folded flexible circuit substrate, where the microstrip transmission line extends along a bottom surface of the folded flexible circuit substrate, transitions to a top surface of the flat flexible circuit substrate, and extends across the opening. In another case, the assembly includes a flat flexible circuit substrate attached to the folded flexible circuit substrate, a coupling strip positioned on a top surface of the flat flexible circuit substrate and extending across the opening, and a via coupling a first end of the coupling strip to the microstrip transmission line.

DETAILED DESCRIPTION

Figure 1:
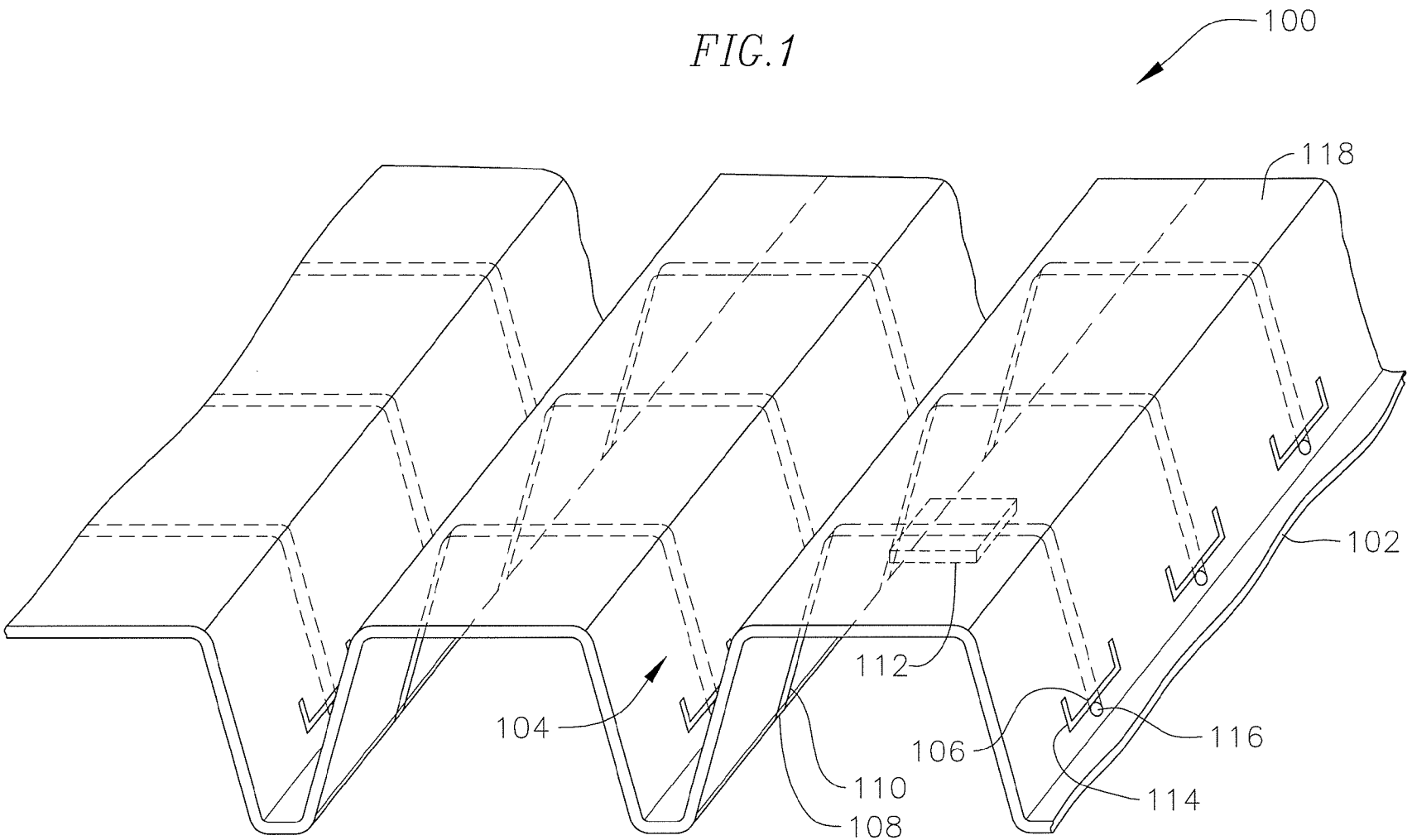
FIG. 1 is a perspective view of a radiator transition assembly including both a folded flexible circuit substrate forming long slot radiators and slot fed radiator transitions for exciting the long slot radiators in accordance with one embodiment of the invention.

Thin flex circuit technologies can be used to build a thin ultra lightweight structural conformal antenna that can meet and surpass the challenging weight requirements for airship and space platforms. Applying three dimensional (3-D) circuitry on a folded/formed RF flex layer is a key enabler to bringing integrations of both electrical and mechanical functions to new heights. This can result in up to a 75% reduction in weight and in the number of dielectric, conductor, and adhesive layers. These methods integrate the microwave transmission line and components, control signal, and DC power manifold into multilayer 3-D fluted flex circuit board assemblies that are lighter weight and more rigid than can be done with conventional technology. This is accomplished with unique and innovative pleaded folding of alternating flex layers to effectively increase the area to route the RF, signal, and power lines onto a single layer without increasing the PCB panel area and minimizing the number of vias and traces within the RF flex circuitry.

To form the lightweight antenna, both a level one (L1) RF feed and a level two (L2) RF feed can be used. Each RF feed can include a formed or folded flexible circuit layer and a flat flexible circuit layer. Each of the folded layers can be formed using innovative processes. Once the components or layers of the L1 and L2 RF feeds have been formed, then a process for assembling the RF feeds and ultimately the entire antenna structure can be performed.

Referring now to the drawings, embodiments of radiator transition assemblies for exciting the long slot radiators of lightweight antennas are illustrated. The radiator transition assemblies include a folded flexible circuit substrate having multiple folds that form long slot radiators and transmit/receive circuitry coupled to a microstrip transmission line positioned along the folded flexible substrate. The microstrip transmission line also extends across an opening of the long slot radiator. In some embodiments, the opening is a slot aperture or coupling slot (i.e., slot fed radiator transition) structured to allow signals travelling along the microstrip transmission line to excite an electromagnetic field that radiates out through the long slot radiators.

In other embodiments, the opening is defined by a space between adjacent folds of a long slot radiator. In such case, the microstrip transmission line or coupling strip extends across the opening defined by the folds (i.e., probe fed radiator transition) and is often positioned on a flat flexible circuit substrate attached to flat areas of a top surface of the folded flexible circuit substrate. In one embodiment, the probe fed radiator transition includes a bifurcated coupling strip having two coupling legs. In a number of embodiments, the radiator transitions extend across an opening and are coupled by a via to a ground plane positioned on a top surface of the folded flexible circuit substrate. In a number of embodiments, the folded and flat flexible circuit substrates can be made of a lightweight material such as a liquid crystal polymer (LCP) material.

FIG. 1 is a perspective view of a radiator transition assembly 100 including both a folded flexible circuit substrate 102 forming long slot radiators 104 and slot fed radiator transitions 106 for exciting the long slot radiators 104 in accordance with one embodiment of the invention. The assembly 100 further includes an RF input 108 coupled to a microstrip transmission line 110 which is coupled to a transmit/receive module chip or TR chip 112. The microstrip transmission line 110 continues away from the TR chip 112 along the bottom surface of the folded flexible substrate 102 and across a slot aperture 114 in the substrate 102 to a via 116 coupled to a ground plane 118. The ground plane 118 is positioned on a top surface of the substrate 102. In one embodiment, the ground plane 118 substantially covers the top surface of the folded flexible substrate 102. In other embodiments, the ground plane 118 can cover only a portion of the folded flexible substrate 102. The slot fed transitions 106 include the microstrip transmission line trace 110 extending across the slot aperture 114 to the ground plane via 116.

In operation, RF signals are received via the RF input 108, travel along the microstrip transmission line 110 and are controlled and/or boosted by the TR chip 112. The modified RF signals, travelling along the microstrip transmission line 110 away from the TR chip 112, extend across the coupling slot or slot aperture 114 to the ground plane via 116. As the modified RF signals cross the coupling slot 114, a voltage potential is created across the coupling slot 114 to excite an electromagnetic field allowing the modified RF signal to travel through the cavity and radiate out through the long slot radiators 104.

In some embodiments, a flat flexible circuit substrate (not shown in FIG. 1) is attached to the top surface of the folded flexible circuit substrate. The flat substrate can add structural integrity to an antenna structure incorporating the folded substrate. In addition, various circuitry and components can be positioned on the flat substrate, including, without limitation, discrete circuit components, semiconductor chips, traces, and ground or power planes.

In the folded flexible circuit substrate depicted in FIG. 1, the folds have a preselected length, spacing and angle of inclination. In other embodiments, the folds can have other lengths, spacing and angles of inclination. In several embodiments, these characteristics can be varied to suit particular applications and impedance matching characteristics thereof.

In the embodiment illustrated in FIG. 1, the slot aperture 114 is elongated with a rectangular lengthwise section that is perpendicular to the microstrip transmission line and two stubs at the ends of the lengthwise section which are positioned transverse to the lengthwise section. In other embodiments, the slot aperture 114 can take other suitable shapes. In one such embodiment, the slot aperture consists of a lengthwise section without the transverse stubs. In a number of embodiments, the shape of the slot aperture or coupling slot can be determined and/or selected for impedance matching.

The folded flexible circuit substrate can be made of a lightweight material such as a liquid crystal polymer (LCP) material. In a number of embodiments, the flexible substrates have copper cladding on one or both surfaces of the substrate and copper circuitry etched on those surfaces. The microstrip transmission line and ground plane can be made of copper of another suitable conductive material.

In several embodiments, the slot aperture can be formed by removing a section of the copper groundplane beneath a top surface of the LCP flexible substrate, typically during an etching process during manufacturing. In one embodiment, the groundplane section is removed after the microstrip transmission line has be routed on the bottom surface of the folded flexible circuit substrate.

Figure 2:
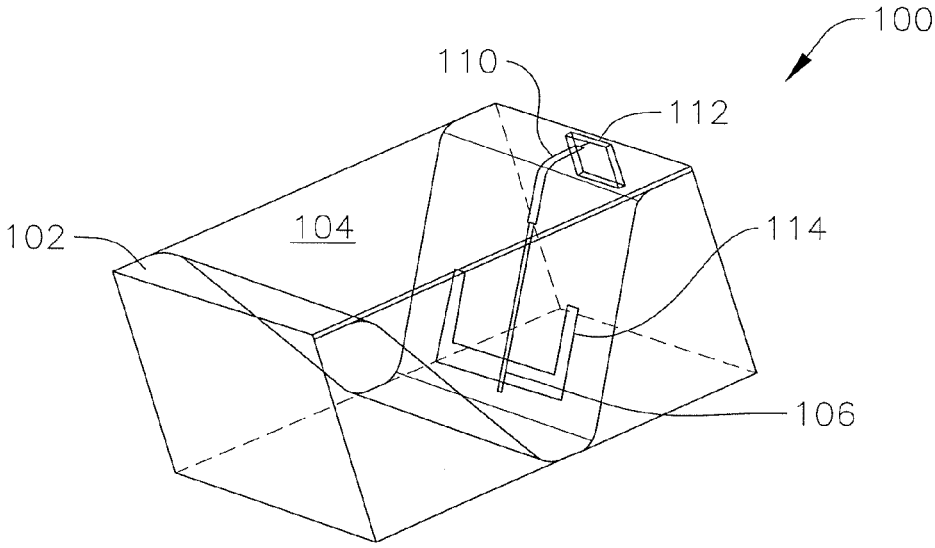
FIG. 2 is an enlarged perspective view of a portion of the radiator transition assembly of FIG. 1 including one of the slot fed radiator transitions in accordance with one embodiment of the invention.

FIG. 2 is an enlarged perspective view of an assembly 100 including a portion of the radiator transition assembly of FIG. 1 and one of the slot fed radiator transitions 106 in accordance with one embodiment of the invention.

Figure 3:
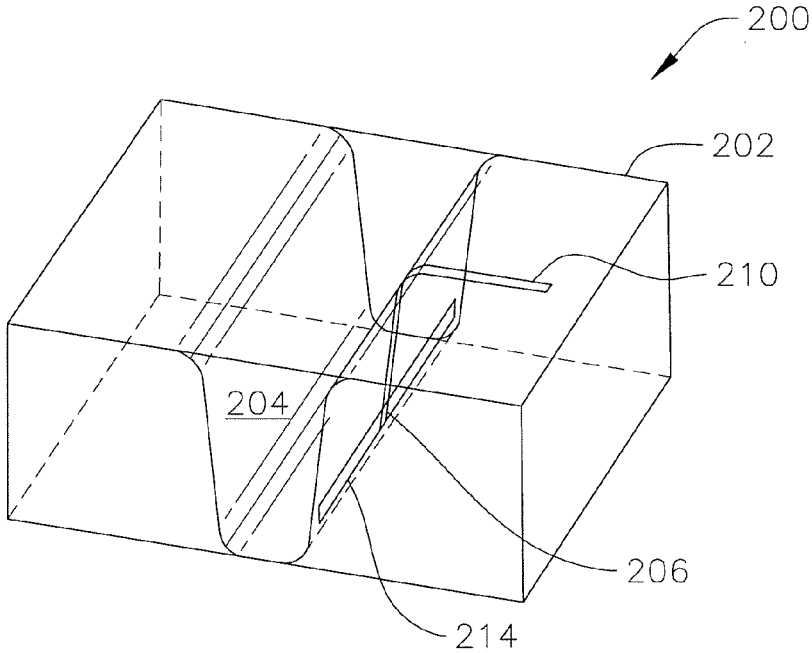
FIG. 3 is a perspective view of a radiator transition assembly including another slot fed radiator transition for exciting a long slot radiator of an RF antenna in accordance with one embodiment of the invention.

FIG. 3 is a perspective view of a radiator transition assembly 200 including another slot fed radiator transition 206 for exciting a long slot radiator 204 of an RF antenna in accordance with one embodiment of the invention. The assembly 200 includes both a folded flexible circuit substrate 202 forming a long slot radiator 204 and the slot fed radiator transition 206. A microstrip transmission line trace 210 extends along a bottom surface of the folded flexible substrate 202 and across a slot aperture or coupling slot 214 having a single lengthwise rectangular section positioned perpendicular to the crossing microstrip transmission line.

In several embodiments, the radiator transition assembly can operate similar to the radiator transition assembly of FIG. 1. In some embodiments, the radiator transition assembly can be structurally varied as discussed above for the radiator transition assembly of FIG. 1.

Figure 4:
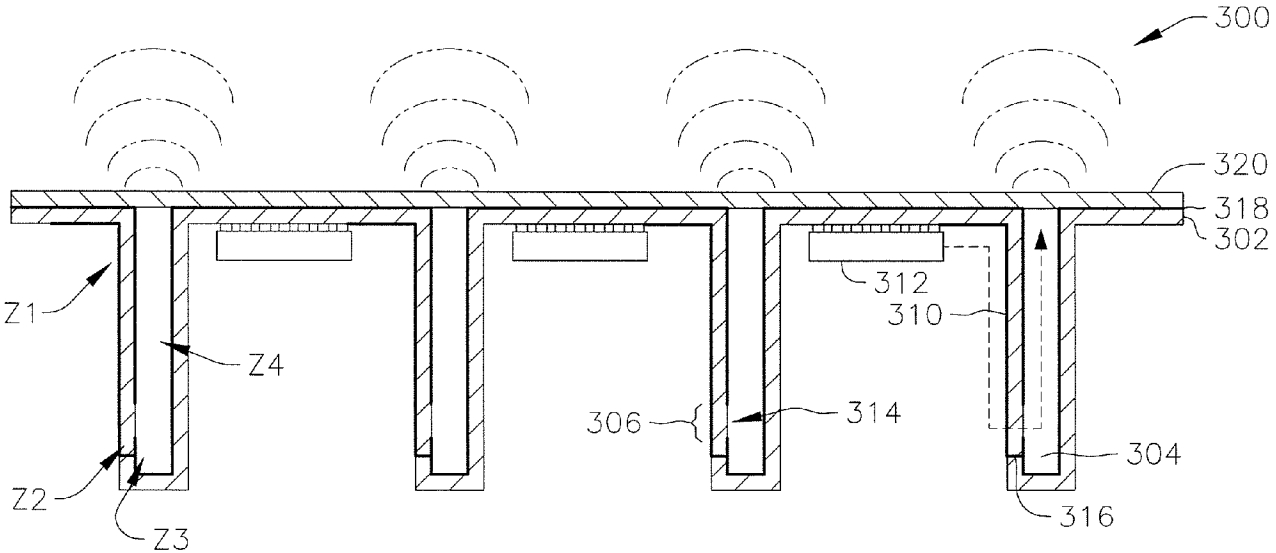
FIG. 4 is a cross sectional view of a model for a radiator transition assembly including slot fed radiator transitions for exciting long slot radiators of an RF antenna in accordance with one embodiment of the invention.

FIG. 4 is a cross sectional view of a model for a radiator transition assembly 300 including slot fed radiator transitions 306 for exciting long slot radiators 304 of an RF antenna in accordance with one embodiment of the invention. The radiator transition assembly 300 includes a folded flexible circuit substrate 302 having folds that form several long slot radiators 304. TR chips 312 are mounted on a bottom surface of the folded flexible circuit substrate 302 and coupled to a microstrip transmission line 310 which extends along the bottom surface across the slot aperture 314 to via 316. The via 316 is coupled to ground plane 318 which is positioned substantially continuously along the top surface of the folded flexible circuit substrate 302. A flat flexible circuit substrate 320 is attached to the top surface of the folded flexible circuit substrate 302 using one or more strips of non-conductive adhesive film (not shown). Impedances associated with one of the radiator transitions include impedance Z1 for the microstrip transmission line, impedance Z2 for the transition 306 and via 316, impedance Z3 for the base area of a long slot radiator and impedance Z4 for the exit area of the long slot radiator.

Figure 5:
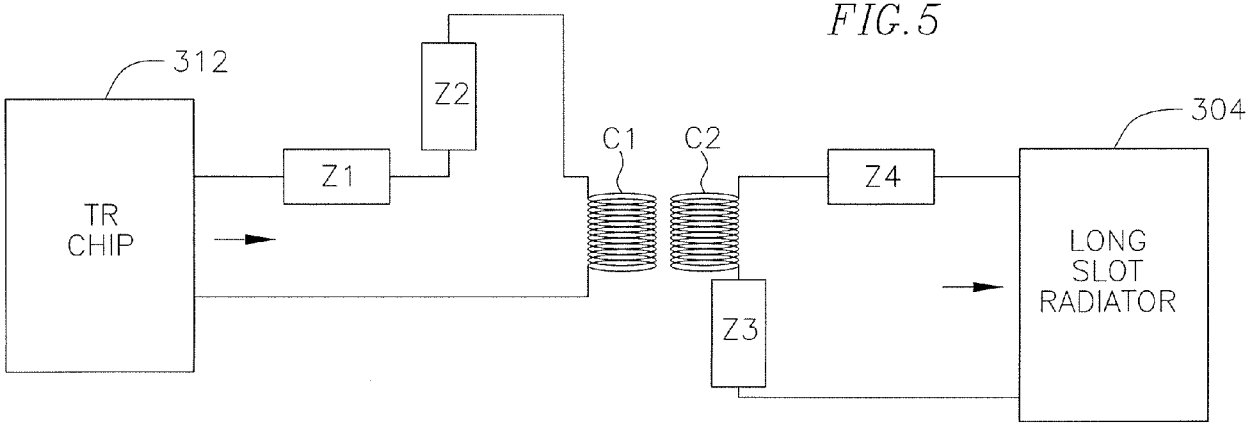
FIG. 5 is a schematic block diagram of the electrical characteristics of one of the slot fed radiator transitions of FIG. 4 in accordance with one embodiment of the invention.

FIG. 5 is a schematic block diagram of the electrical characteristics of one of the slot fed radiator transitions of FIG. 4 in accordance with one embodiment of the invention. A signal provided by the TR chip 312 can pass through impedances Z1 and Z2 before experiencing the slot coupling which is modeled by an ideal transformer with adjacent coils C1 and C2. A signal changing from one transmission configuration to another as it passes through the ideal transformer can pass through both impedances Z4 and Z3 in order to exit the long slot radiator 304 and be emanated as RF energy.

Figure 6:
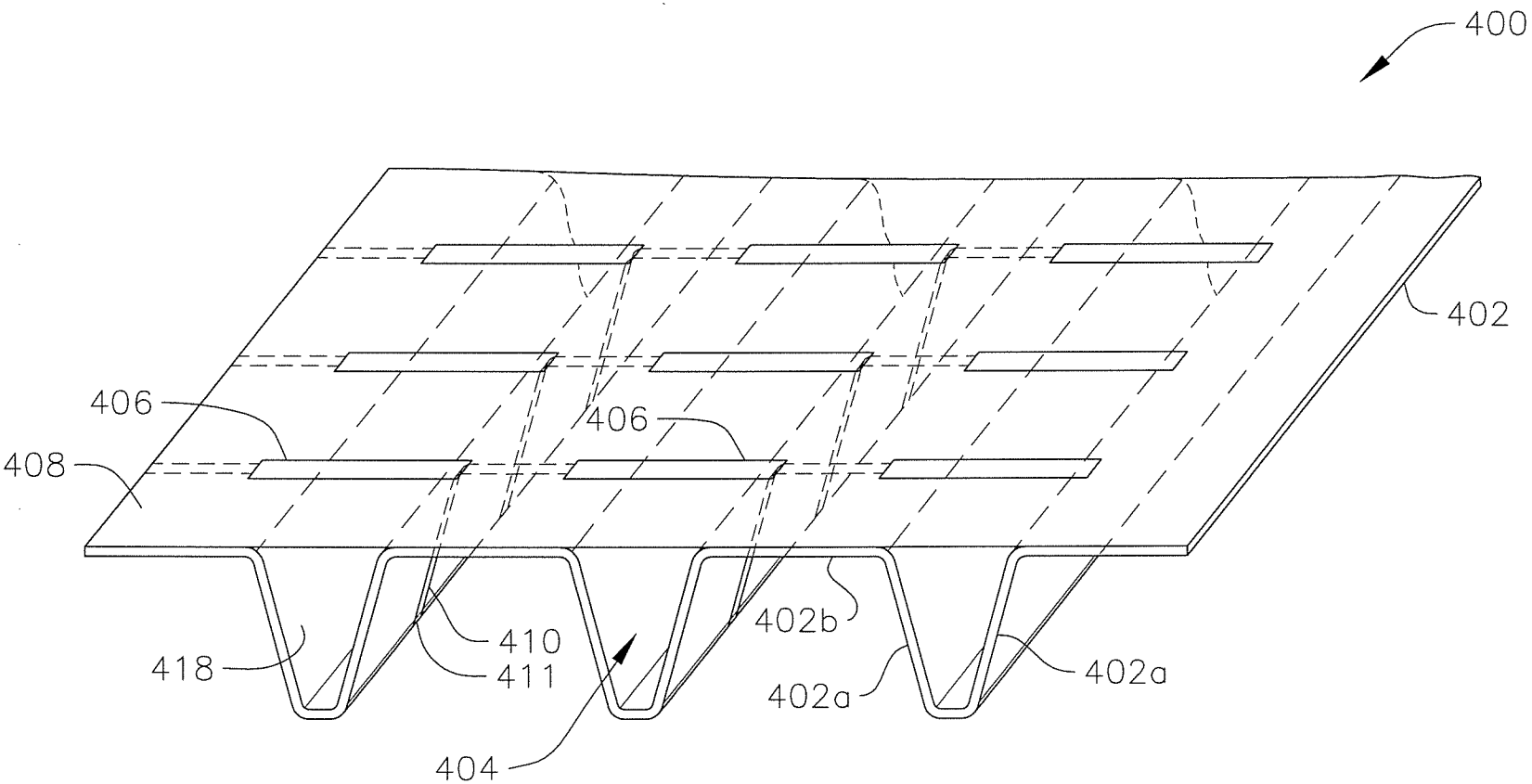
FIG. 6 is a perspective view of a radiator transition assembly including a folded flexible circuit substrate having folds that form long slot radiators and probe fed radiator transitions positioned between the folds and on a flat flexible circuit substrate for exciting the long slot radiators in accordance with one embodiment of the invention.

FIG. 6 is a perspective view of a radiator transition assembly 400 including both a folded flexible circuit substrate 402 having folds 402*a* that form long slot radiators 404 and probe fed radiator transitions 406 positioned between the folds 402*a* and on a flat flexible circuit substrate 408 for exciting the long slot radiators 404 in accordance with one embodiment of the invention. RF signals can be received at an RF input 411 and travel along microstrip transmission line 410 on the bottom surface of folded flexible circuit substrate 402 to a TR chip (not shown).

From the TR chip, modified RF signals travel along the microstrip transmission line 410 to a via 413 (see FIG. 7) extending through a clearance hole 415 (see FIG. 7) in a ground plane 418 on the top surface of the folded flexible circuit substrate 402. From the via 413, the modified RF signals travel along a probe fed radiator transition or coupling strip (e.g., second microstrip transmission line trace) 406 to another via 417 (see FIG. 7) to the ground plane 418. The coupling strip 406 extends across adjacent folds 402*a* of the long slot radiator and RF signals passing thereon can create a voltage potential that excites an electromagnetic field within the radiator cavity. In such case, because the cavity 404 is terminated by a short to ground, at the end of the cavity 404 furthest from the flat flexible substrate 408, that is a quarter wavelength away from the long slot (end of cavity 404 defined by the opening closest to flat substrate 408), the electromagnetic field radiates out through the long slot radiator (see e.g., FIG. 8). In other embodiments, a floating ground or other suitable grounding technique known in the art can be used instead of the short to ground. In one embodiment, for example, the floating ground includes a capacitor coupled to ground.

In the embodiment illustrated in FIG. 6, the coupling strip 406 is coupled to ground. In other embodiments, a quarter wavelength open circuited transmission line stub can be used instead.

Figure 7:
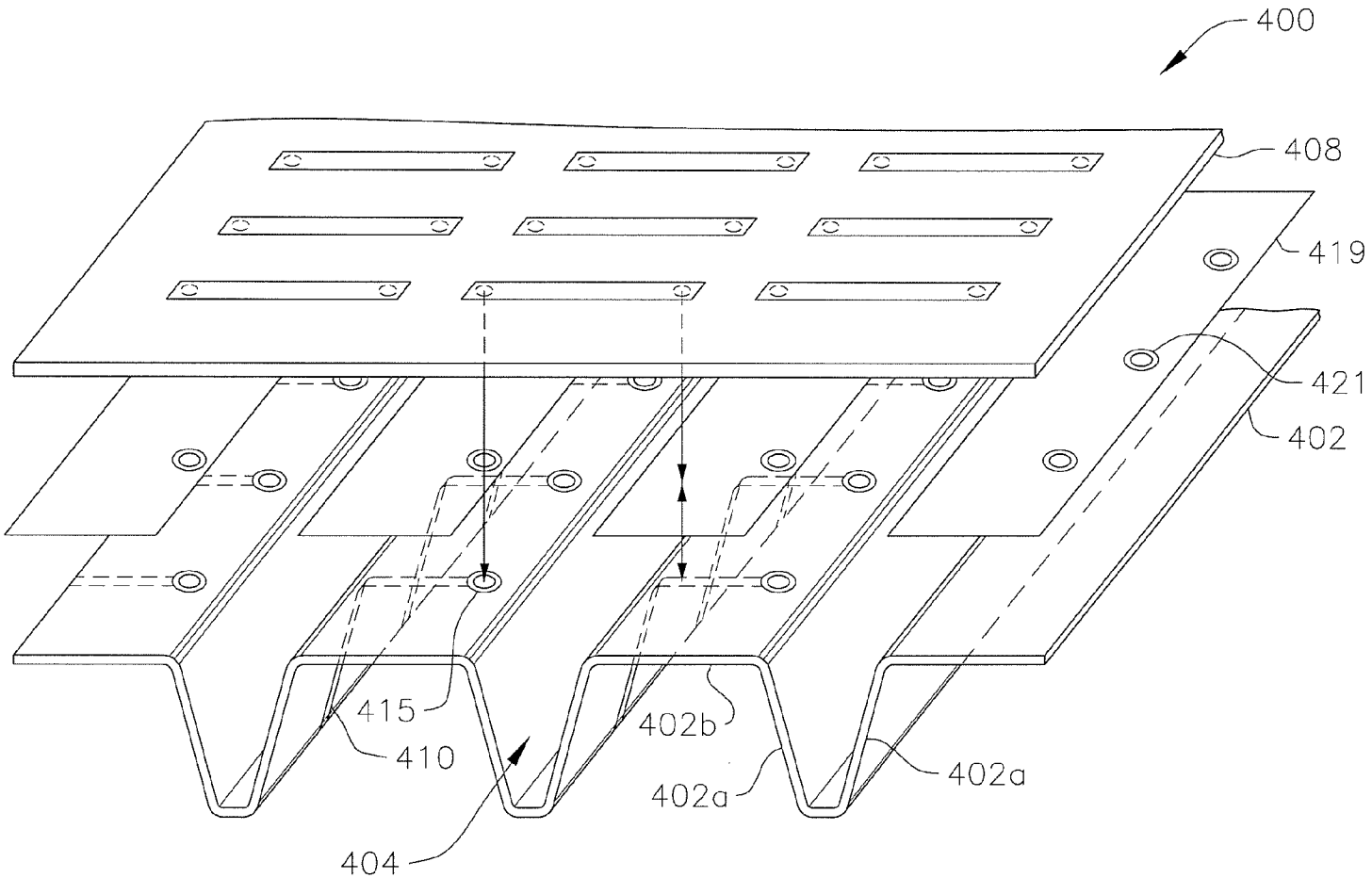
FIG. 7 is an exploded perspective view of the radiator transition assembly and probe fed radiator transitions of FIG. 6 in accordance with one embodiment of the invention.

FIG. 7 is an exploded perspective view of the radiator transition assembly 400 and probe fed radiator transitions 406 of FIG. 6 in accordance with one embodiment of the invention. Wide adhesive strips 419 are positioned between the flat flexible circuit substrate 408 and the folded flexible circuit substrate 402. The wide adhesive strips 419 have rectangular shapes configured to substantially cover upper flat sections 402*b* of the folded flexible circuit substrate 402. In addition, each wide adhesive strips 419 includes multiple cutouts 421 that correspond in position to the vias (413, 417) and clearance holes 415.

In one embodiment, the adhesive strips are made of an adhesive film material such as ABLEBOND 84-1 made by Ablestik Laboratories of Rancho Dominguez, Calif. In several embodiments the coupling strip is made of copper or another suitable conductive material. In a number of embodiments, the radiator transition assembly can operate and be modified as described above for the radiator transition assemblies of FIGS. 1-3.

Figure 8:
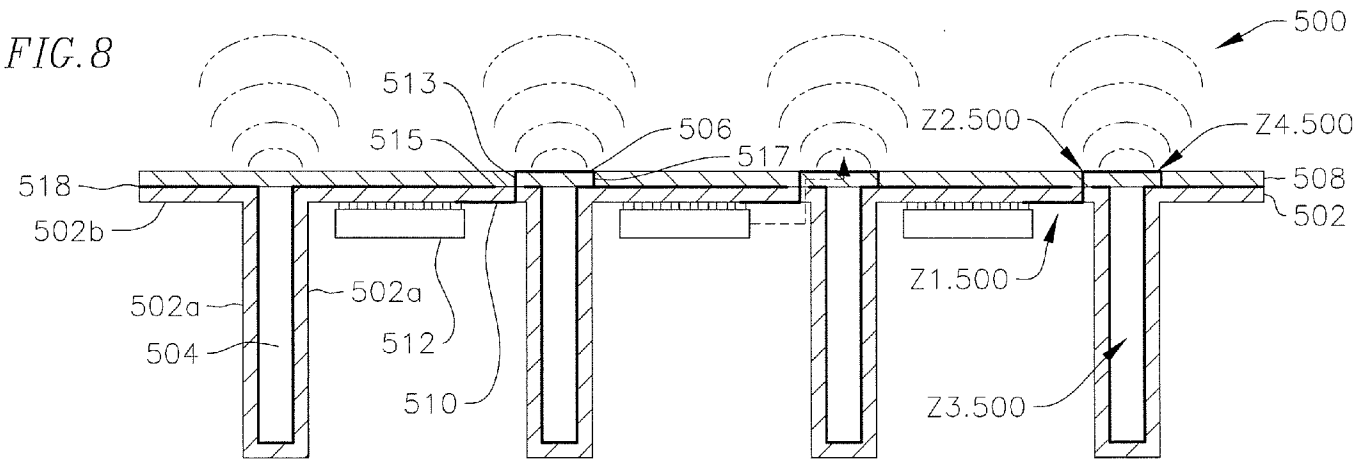
FIG. 8 is a cross sectional view of a model for a radiator transition assembly including probe fed radiator transitions for exciting the long slot radiators of an RF antenna in accordance with one embodiment of the invention.

FIG. 8 is a cross sectional view of a model for a radiator transition assembly 500 including probe fed radiator transitions 506 for exciting the long slot radiators 504 of an RF antenna in accordance with one embodiment of the invention. The radiator transition assembly 500 includes a flat flexible circuit substrate 508 attached to a folded flexible circuit substrate 502 having folds 502*a* that form several long slot radiators 504. TR chips 512 are mounted on a bottom surface of the folded flexible circuit substrate 502 and coupled to a microstrip transmission line 510 which extends along the bottom surface of the folded flexible substrate 502. The microstrip transmission line 510 then transitions from the bottom surface of the folded substrate 502 to a second microstrip transmission line trace or coupling strip 506 on a top surface of the flat flexible circuit substrate 508 by way of a via 513. The coupling strip 506 extends across an opening in the long slot radiator 504 defined by a space between adjacent folds 502*a* of the folded flexible circuit substrate 502. At the end opposite the via 513, the coupling strip 506 is connected by a second via 517 to a ground plane 518 positioned on the top surface of the folded flexible circuit substrate 502.

Impedances associated with one of the probe fed radiator transitions include impedance Z1.500 for the microstrip transmission line, impedance Z2.500 for the transition from the bottom surface of the folded substrate 502 to the top surface of the flat substrate 508, and impedance Z3.500 for the base area of a long slot radiator 504.

Figure 9:
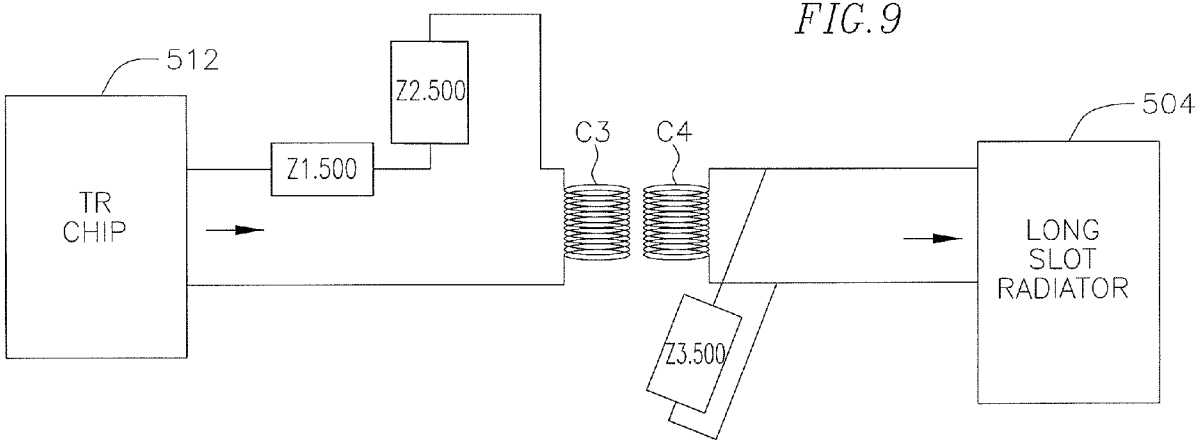
FIG. 9 is a schematic block diagram of the electrical characteristics of one of the probe fed radiator transitions of FIG. 8 in accordance with one embodiment of the invention.

FIG. 9 is a schematic block diagram of the electrical characteristics of one of the probe fed radiator transitions of FIG. 8 in accordance with one embodiment of the invention. An excitation signal provided by the TR chip 512 can pass through impedances Z1.500 and Z2.500 before experiencing the probe coupling which is modeled by an ideal transformer including coil C3 in close proximity to coil C4. A signal changing from one transmission configuration to another as it passes through the ideal transformer can pass through can pass through a parallel combination of impedance Z3.500 and an impedance of the long slot radiator in order to exit the long slot radiator and be emanated as RF energy.

Figure 10:
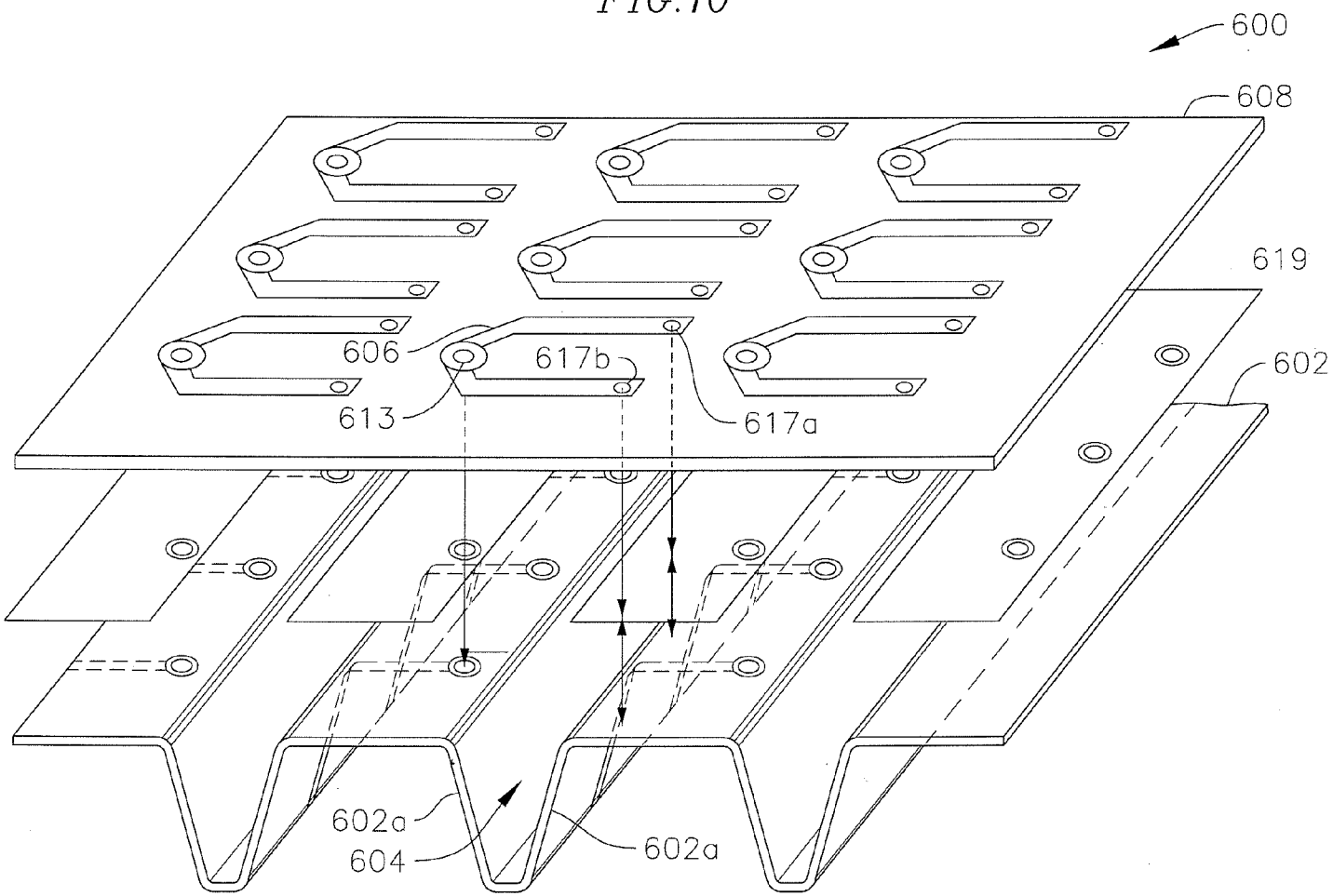
FIG. 10 is an exploded perspective view of a radiator transition assembly including bifurcated probe fed radiator transitions for exciting long slot radiators of an RF antenna in accordance with one embodiment of the invention.

FIG. 10 is an exploded perspective view of a radiator transition assembly 600 including bifurcated probe fed radiator transitions 606 for exciting long slot radiators 604 of an RF antenna in accordance with one embodiment of the invention. The radiator transition assembly 600 includes a flat flexible circuit substrate 608 separated by non-conductive adhesive strips or films 619 from a folded flexible circuit substrate 602 having folds 602*a* that form several long slot radiators 604. Multiple bifurcated probe fed radiator transitions 606 are positioned on a top surface of the flat flexible circuit substrate 608.

The bifurcated probe fed radiator transitions 606 include two probe legs or coupling legs that are joined at a first end coupled by a first via 613. At ends of the two probe legs opposite to the first end having the first via 613, additional vias (617*a*, 617*b*) are positioned. In several embodiments, the first via 613 is coupled to a microstrip transmission line positioned on a bottom surface of the folded flexible circuit substrate 602, and the additional vias (617*a*, 617*b*) are coupled to a ground plane on a top surface of the folded flexible circuit substrate 602. In a number of embodiments, the radiator transition assembly 600 can be operated and modified in the manner described above for the radiator transition assembly of FIG. 7.

Figure 11:
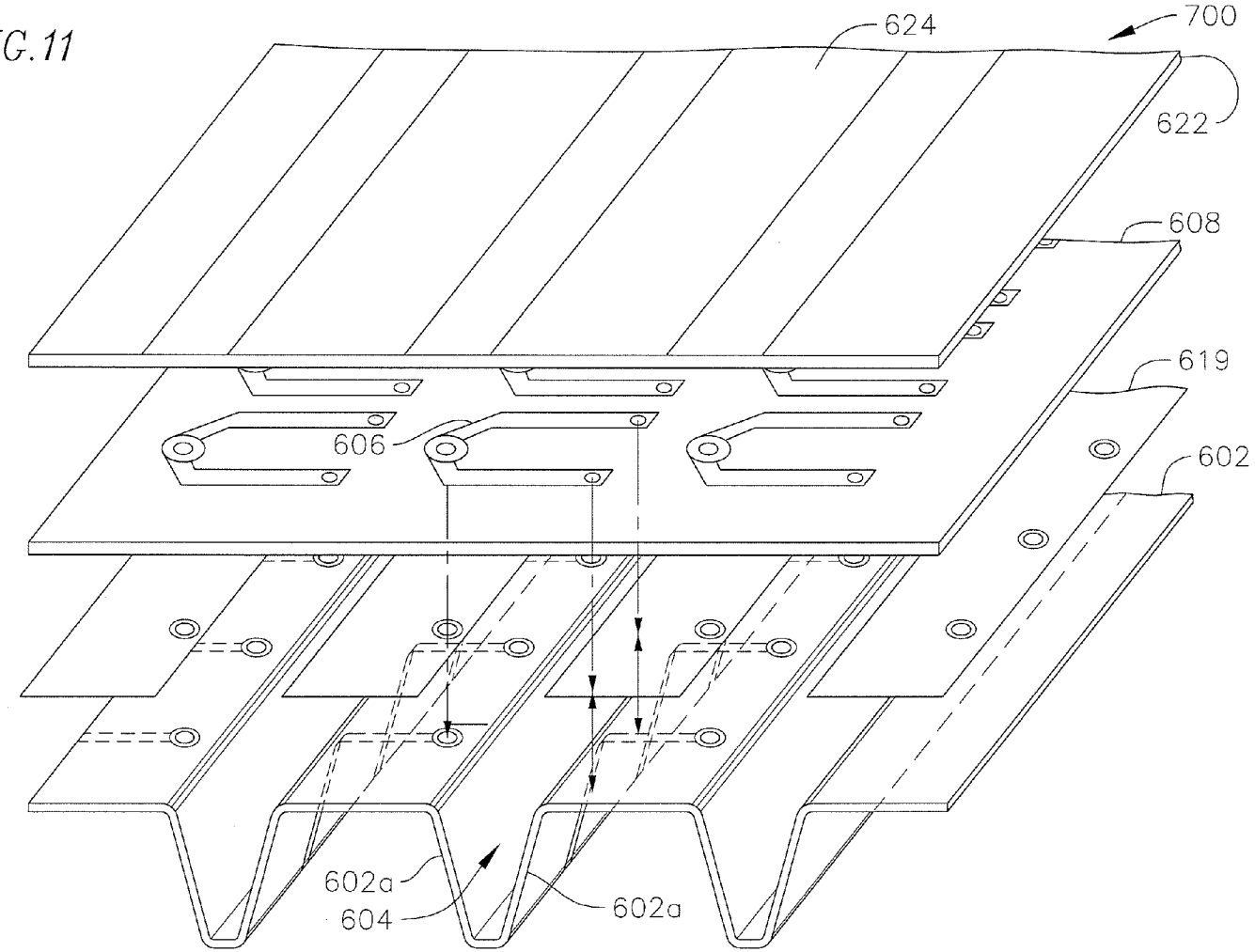
FIG. 11 is an exploded perspective view of a radiator transition assembly including the radiator transition assembly of FIG. 10 along with tuning planes for tuning the long slot radiators in accordance with one embodiment of the invention.

FIG. 11 is an exploded perspective view of a radiator transition assembly 700 including the radiator transition assembly 600 of FIG. 10 along with tuning planes 624 for tuning the long slot radiators 604 in accordance with one embodiment of the invention. As compared to the radiator transition assembly 600 of FIG. 10, radiator transition assembly 700 further includes a second flat flexible circuit substrate 622 having multiple tuning planes or tuning strips 624 positioned on a top surface thereof for tuning the long slot radiators 604. The tuning planes 624 have a rectangular shape configured to substantially cover the openings of the long slot radiators 604 defined by the spaces between folds 602*a* of the folded flexible circuit substrate 602. While the tuning planes 624 of FIG. 11 depict particular preselected dimensions, the dimensions of the tuning planes can be modified in accordance with a particular desired impedance for matching the impedance of other various antenna components.

Figure 12:
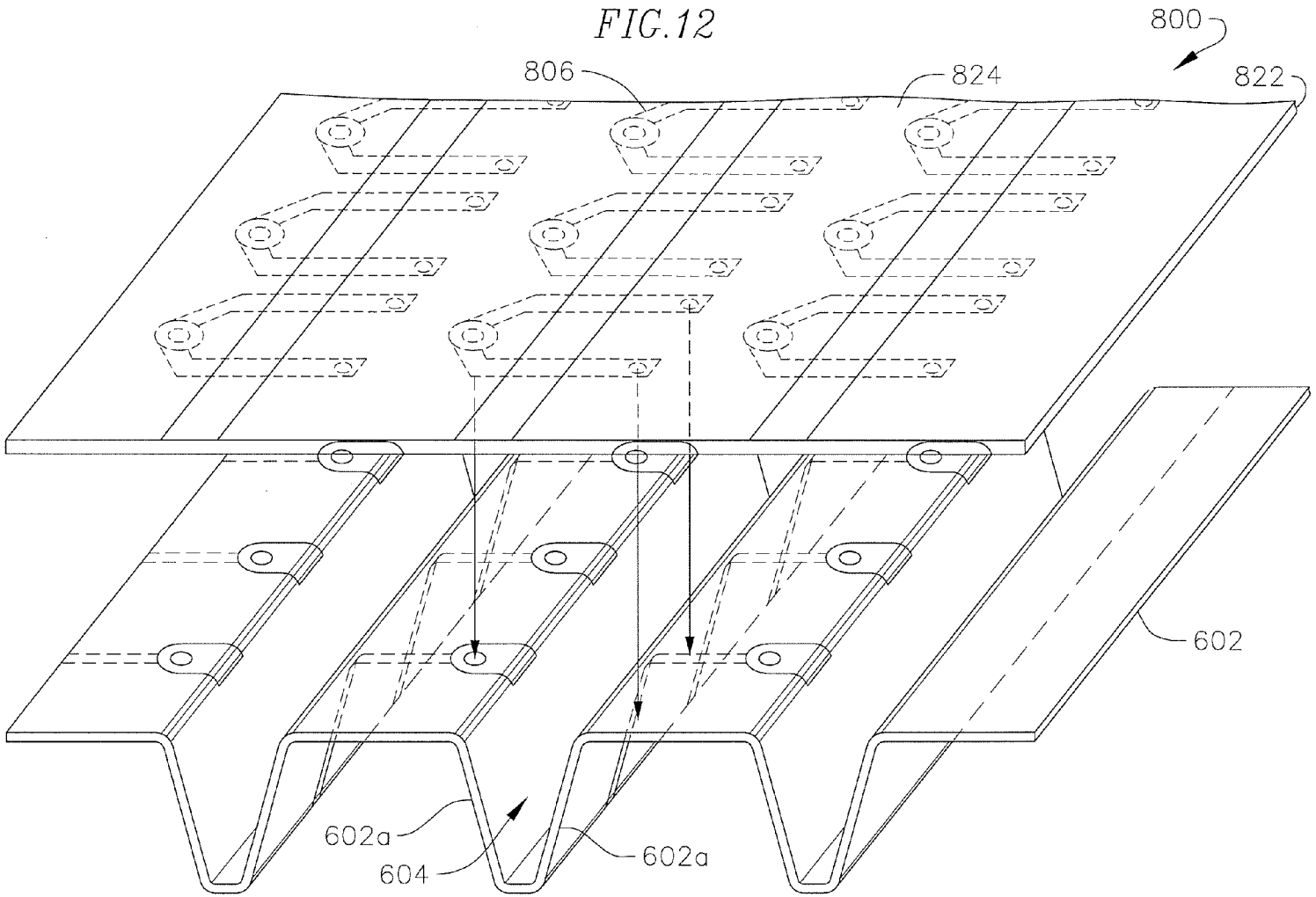
FIG. 12 is an exploded perspective view of the radiator transition assembly including both the bifurcated probe fed radiator transitions of FIG. 10 and tuning planes for tuning the long slot radiators positioned on a single flat flexible circuit substrate in accordance with one embodiment of the invention.

FIG. 12 is an exploded perspective view of a radiator transition assembly 800 including both the radiator transition assembly of FIG. 10 and tuning planes 824 for tuning the long slot radiators 604 positioned on a single flat flexible circuit substrate 822 in accordance with one embodiment of the invention. As compared to the radiator transition assembly 600 of FIG. 10, radiator transition assembly 800 includes the flat flexible circuit substrate 822 having multiple tuning planes 824 positioned on a top surface thereof for tuning the long slot radiators 604. The bifurcated probe fed radiator transitions 606 have been moved to a bottom surface of the flat flexible circuit substrate 822. In such case, the radiator transition assembly 800 can eliminate one of the flat flexible circuit substrates used in the radiator transition assembly 700 of FIG. 11.

The tuning planes 824 have a rectangular shape configured to substantially cover the openings of the long slot radiators 604 defined by the spaces between folds 602*a* of the folded flexible circuit substrate 602. While the tuning planes 824 of FIG. 11 depict particular preselected dimensions, the dimensions of the tuning planes can be modified in accordance with a particular desired impedance for matching the impedance (s) of other various antenna components.

Figure 13:
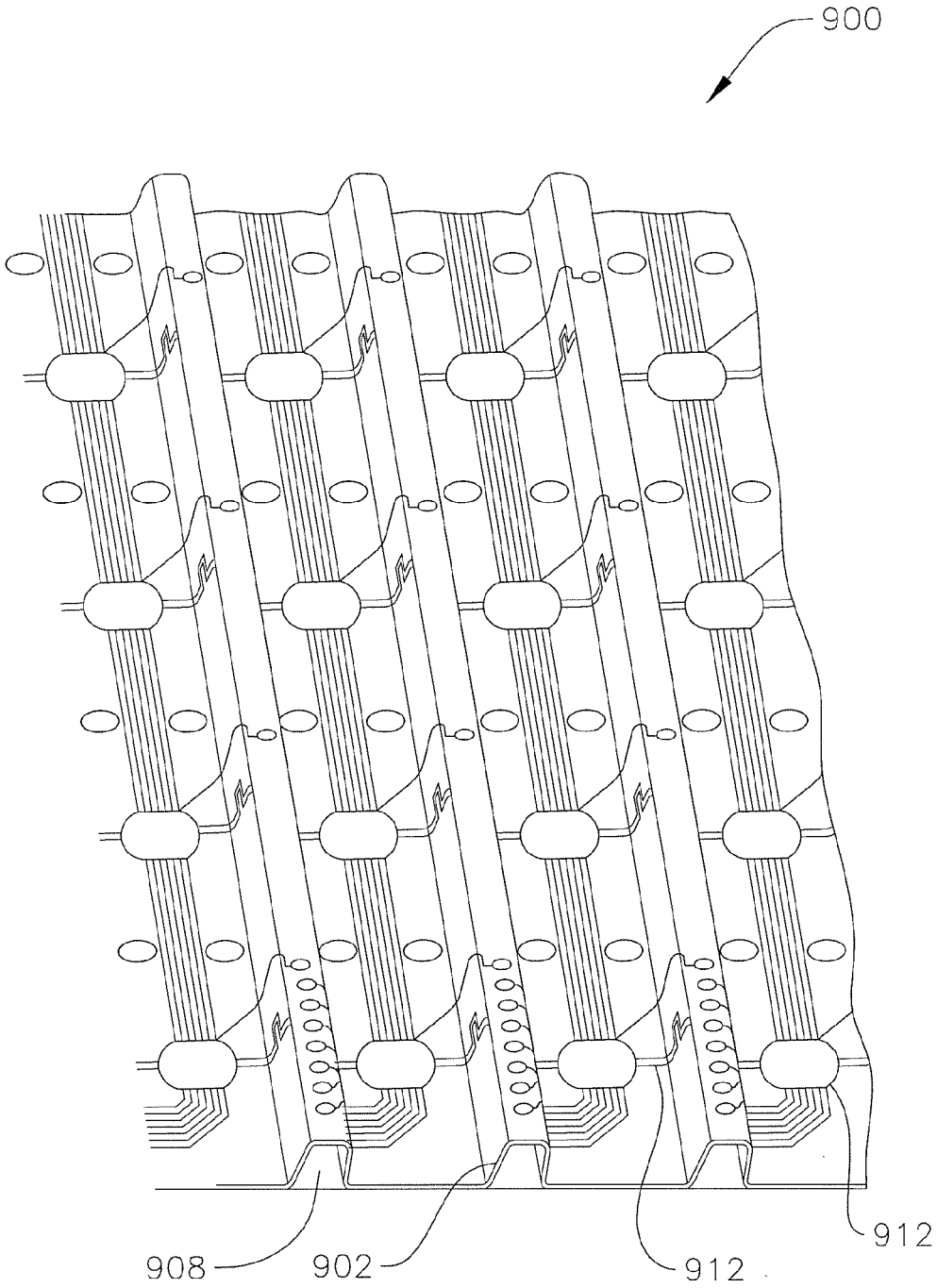
FIG. 13 is a perspective view of a radiator transition assembly including slot fed radiator transitions for an RF antenna in accordance with one embodiment of the invention.

FIG. 13 is a perspective view of a radiator transition assembly 900 including slot fed radiator transitions on a portion of an RF antenna structure in accordance with one embodiment of the invention. The radiator transition assembly 900 includes a folded flexible circuit substrate 902 attached to a flat flexible circuit substrate 908. Pads 912 for TR chips are positioned on a bottom surface of the folded flexible circuit substrate 902. Microstrip transmission lines 910 extend from the TR chips 912 along the bottom surface of the folded flexible circuit substrate 902.

Figure 14:
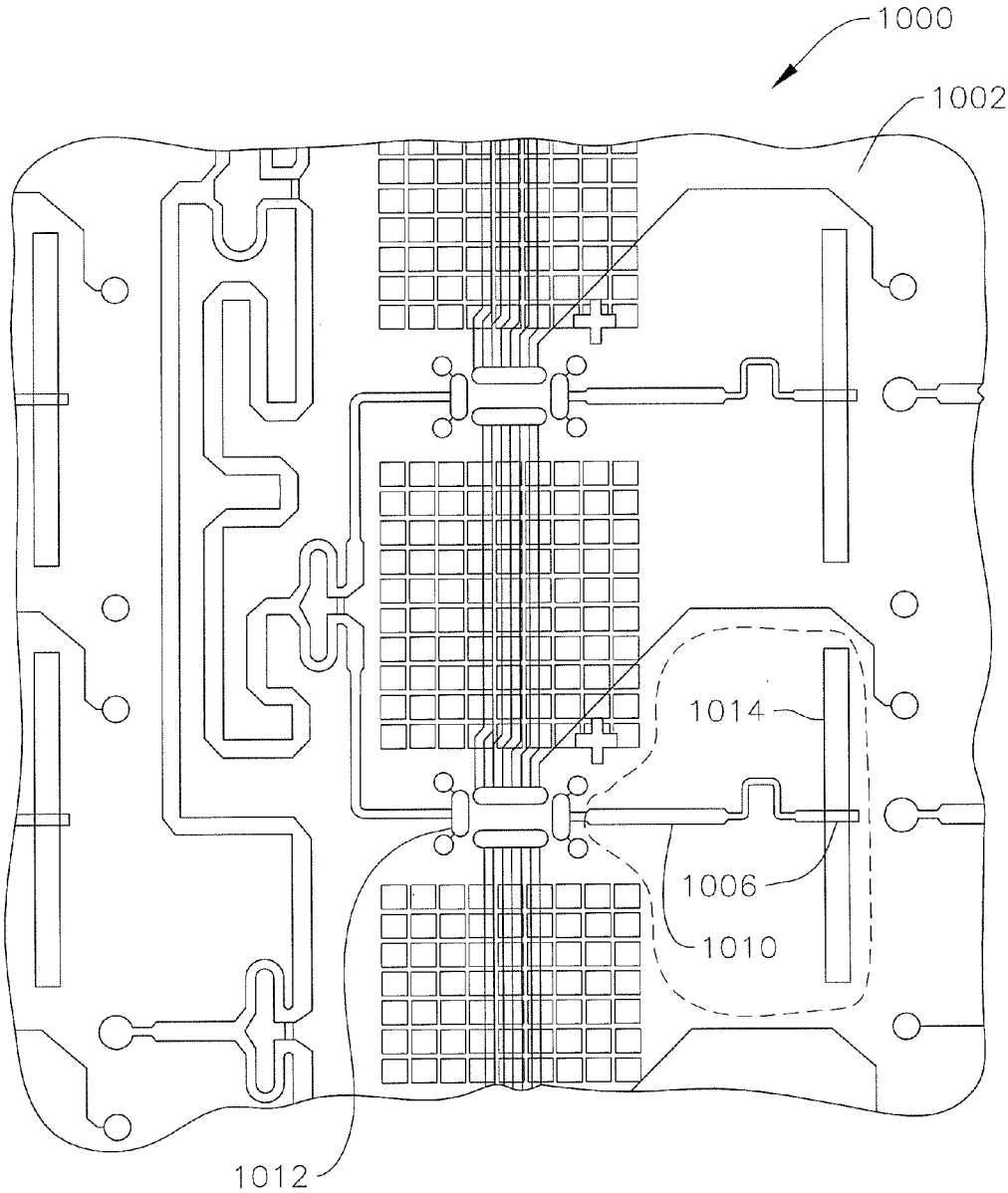
FIG. 14 is a circuit layout view of a radiator transition assembly including slot fed radiator transitions of FIG. 13 in accordance with one embodiment of the invention.

FIG. 14 is a circuit layout view of a radiator transition assembly 1000 including slot fed radiator transitions 1006 on a portion of the RF antenna structure of FIG. 13 in accordance with one embodiment of the invention. The radiator transition assembly 1000 further includes a layout surface 1002 (e.g., bottom surface of a folded flexible circuit substrate). Pads 1012 for TR chips are positioned on the layout surface 1002. Microstrip transmission lines 1010 extend from the TR chips 1012 along the layout surface 1002 across a slot aperture or coupling slot 1014 thereby forming a slot fed radiator transition 1006. The radiator transition assembly 1000 can operate and be modified as described above for the radiator transition assemblies of FIGS. 1-3.

Figure 15:
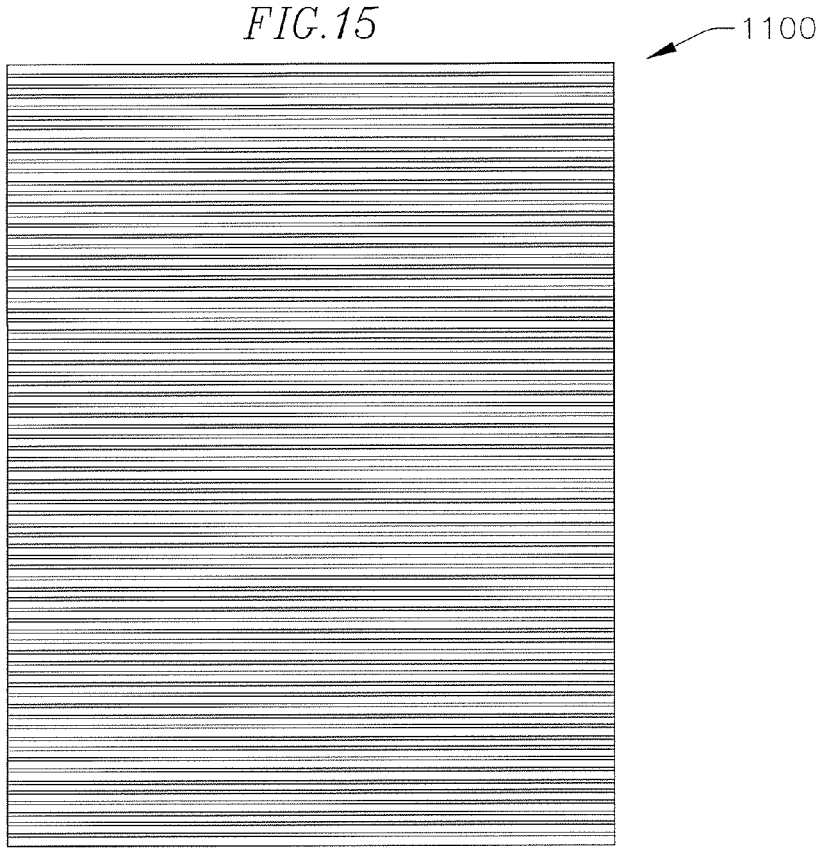
FIG. 15 is a top view of an RF antenna structure constructed of lightweight materials including a radiator transition assembly having radiator transitions in accordance with one embodiment of the invention.

FIG. 15 is a top view of an RF antenna structure 1100 constructed of lightweight materials including a radiator transition assembly having radiator transitions in accordance with one embodiment of the invention. The RF antenna structure can act as or be a component of an antenna used in an active array radar system. In other embodiments, it may be used in other radar or communication systems.

Figure 16:
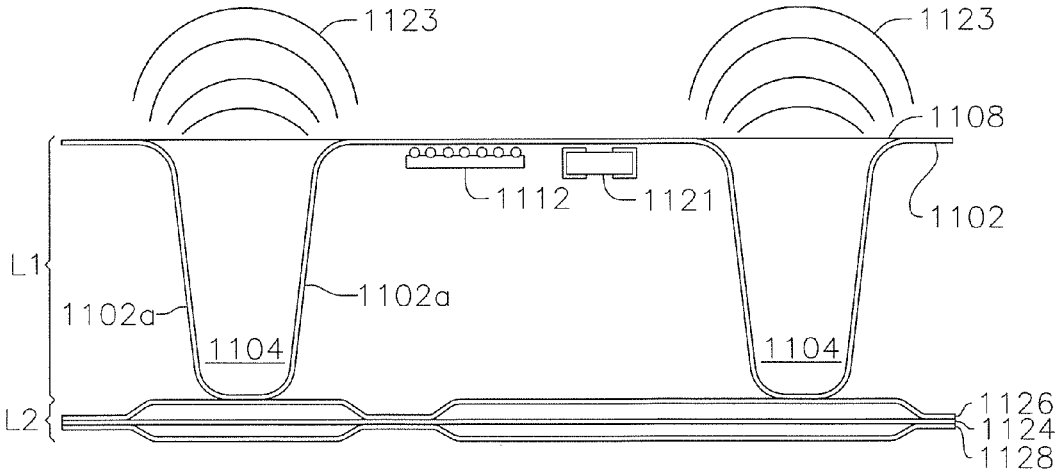
FIG. 16 is a side view of a portion of the RF antenna structure of FIG. 15 illustrating a level one RF feed assembly mounted to a level two RF feed assembly in accordance with one embodiment of the invention.

FIG. 16 is a side view of a portion of the RF antenna structure 1100 of FIG. 15 illustrating a level one RF feed (L1) assembly mounted to a level two RF feed (L2) assembly in accordance with one embodiment of the invention. The L1 assembly includes a folded flexible circuit layer 1102 and a flat flexible circuit layer 1108 where the folded areas of flexible layer 1102 form elongated channels, or long slot radiators, 1104 that radiate RF energy 1123 when excited. Electrical components such as TR chips 1112 and capacitors 1121 are mounted to a bottom surface of the folded flex circuit layer 1102. In a number of embodiments, the flexible circuit layers are formed of a lightweight material such as a liquid crystal polymer LCP material.

The L2 feed "sandwich" assembly is attached below the L1 feed assembly. The L2 feed assembly consists of three layers of LCP; a flat center layer 1124, and molded/formed top 1126 and bottom covers 1128. The RF signals in the structure can support a suspended air-stripline transmission line design. In such case, the RF signals can travel within a cavity made by the top cover 1126 and the bottom cover 1128. The center layer 1124 provides the RF signal trace routing. The top and bottom covers are plated on the inside of the cavity, providing the RF ground for the airline. As the topology of the 3-D antenna assembly varies across the assembly, use of different types of transmission lines on different sections of the assembly can maximize antenna performance. Therefore, transitions from one type of transmission line to another are useful for the three dimensional antenna structure. A description of an RF transition that can be used in conjunction with the L2 feed assembly is described in a co-pending U.S. patent application Ser. No. 12/620,467, entitled, "RF Transition with 3-Dimensional Molded Structure", the entire content of which is incorporated herein by reference.

On the outside of the top and bottom covers of the L2 assembly, digital control signals and power distribution lines can be routed. The traces and plating on the layers can be copper. However, in order to meet more strict weight requirements, the plating can also be replaced with aluminum. Similar traces and plating materials can be used for the L1 feed assembly.

The L1 feed assembly is bonded to the L2 feed assembly, and together they form the RF antenna array structure. In one embodiment, the L1 feed is approximately 7.8 mm tall, the L2 feed is approximately 1.4 mm tall, and therefore the entire assembly is approximately 9.2 mm tall (not including support electronics placed on the L2 assembly or any mounting standoffs). Each array panel of the RF antenna can be approximately 0.945 m by 1.289 m, or an area of 1.218 $m^2$. In several embodiments, each panel is electrically and mechanically independent from other panels. In other embodiments, the feeds and panels can have other suitable dimensions.

Support electronics for an active array antenna, such as the beam steering computer (BSC) and the power control modules (PCMs) can be attached to the back side of the L2 feed assembly. Communication in and out of the panels can be provided by a pair of fiber optic cables. The fiber cables enable communication with electronics located off the antenna structure, and the opto-electronics mounted on the backside of the Level 2 feed.

The level one (L1) RF feed for the RF antenna structure can be fabricated using specialized processes for shaping flexible circuit substrates. The fabrication process is described in a co-pending U.S. patent application Ser. No. 12/620,544, entitled "Process for Fabricating An Origami Formed Antenna Radiating Structure", the entire content of which is expressly incorporated herein by reference.

The level two (L2) RF assembly for the RF antenna structure can be fabricated using other specialized processes for shaping flexible circuit substrates. A process for fabricating a level two RF assembly for an RF antenna structure is described in co-pending U.S. patent application Ser. No. 12/620,562, entitled "Process for Fabricating A Three Dimensional Molded Feed Structure", the entire content of which is expressly incorporated herein by reference.

Processes for assembling the level one and level two feeds are described in co-pending U.S. patent application Ser. No. 12/620,490, entitled "Systems and Methods for Assembling Lightweight RF Antenna Structures", the entire content of which is expressly incorporated herein by reference.

In order to deliver RF signals to active elements of a radiating long slot aperture of an L1 feed, an RF matched interconnect can be made between the radiating slot structure and the L2 RF feed. In the case of a lightweight antenna, the interconnect is preferably electrically sound as well as structurally sound. A process for electrically and physically interconnecting L1 and L2 feeds is described in co-pending U.S. patent application Ser. No. 12/534,077, entitled "Multi-Layer Microwave Corrugated Printed Circuit Board and Method", the entire content of which is expressly incorporated herein by reference.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A radiator transition assembly for exciting a long slot radiator of an antenna, the transition assembly comprising:

a folded flexible circuit substrate comprising at least two folds forming a long slot radiator;

an excitation circuitry configured to generate signals for exciting the long slot radiator; and a microstrip transmission line coupled to the excitation circuitry and positioned along the folded flexible circuit substrate, wherein the microstrip transmission line extends across an opening of the long slot radiator, wherein the opening is defined by a space between adjacent folds of the folded flexible circuit substrate;

a flat flexible circuit substrate attached to the folded flexible circuit substrate;

a coupling strip positioned on a to surface of the flat flexible circuit substrate and extending across the opening;

a via coupling a first end of the coupling strip to the microstrip transmission line; a ground plane positioned on a to surface of the folded flexible circuit substrate, wherein the microstrip transmission line is positioned on a bottom surface of the folded flexible circuit substrate; and a second via coupling the ground plane to a second end of the coupling strip, wherein second end of the coupling strip is opposite to the first end of the coupling strip.

2. The radiator transition assembly of claim 1, wherein the flat flexible circuit substrate is attached to the folded flexible circuit substrate using one or more non-conductive adhesive strips.

3. The radiator transition assembly of claim 1, wherein the opening comprises a slot aperture in the folded flexible circuit substrate.

4. The radiator transition assembly of claim 3, wherein the opening comprises a elongated rectangular shape.

5. The radiator transition assembly of claim 4, wherein the opening further comprises two transverse stubs, each having an end joining one of the ends of the elongated rectangular shape.

6. The radiator transition assembly of claim 3, further comprising a flat flexible circuit substrate attached to the folded flexible circuit substrate at a first end of the folded flexible circuit substrate;

wherein the slot aperture is positioned proximate to a second end of the long slot radiator opposite to the first end.

7. The radiator transition assembly of claim 1, further comprising:

at least one tuning strip positioned to partially cover the long slot radiator, wherein the at least one tuning strip comprises a conductive material.

8. The radiator transition assembly of claim 7, wherein the at least one tuning strip is positioned on a top surface of the flat flexible circuit substrate.

9. The radiator transition assembly of claim 7, further comprising a second flat flexible circuit substrate attached to the flat flexible circuit substrate, wherein the at least one tuning strip is positioned on a surface of the second flat flexible circuit substrate.

10. The radiator transition assembly of claim 1, wherein the microstrip transmission line comprises copper.

11. The radiator transition assembly of claim 1, wherein the folded flexible circuit substrate comprises a liquid crystal polymer material.

12. The radiator transition assembly of claim 1, wherein the excitation circuitry comprises a transmit/receive chip circuitry configured to generate signals for exciting a radiator of an antenna.

13. The radiator transition assembly of claim 1, wherein the microstrip transmission line extends along a bottom surface of the folded flexible circuit substrate, transitions to a top surface of the flat flexible circuit substrate, and extends across the opening.

14. The radiator transition assembly of claim 1:

wherein the via is positioned within a first clearance hole in the flat flexible circuit substrate, and wherein the second via is positioned within a second clearance hole in the flat flexible circuit substrate.

15. The radiator transition assembly of claim 1, wherein the coupling strip comprises two coupling legs, each extending across the opening.

16. The radiator transition assembly of claim 15, further comprising:

a ground plane positioned on a top surface of the folded flexible circuit substrate, wherein the microstrip transmission line is positioned on a bottom surface of the folded flexible circuit substrate;

a second via coupling the ground plane to an end of a first coupling leg of the coupling strip; and a third via coupling the ground plane to an end of a second coupling leg of the coupling strip.

17. The radiator transition assembly of claim 1, further comprising:

at least one tuning strip positioned on a top surface of the flat flexible circuit substrate to partially cover the long slot radiator, the at least one tuning strip comprising a conductive material.

* * * * *